US010094174B2

(12) United States Patent
Jain et al.

(10) Patent No.: US 10,094,174 B2
(45) **Date of Patent: *Oct. 9, 2018**

(54) EARTH-BORING TOOLS INCLUDING PASSIVELY ADJUSTABLE, AGGRESSIVENESS-MODIFYING MEMBERS AND RELATED METHODS

(71) Applicant: Baker Hughes Incorporated, Houston, TX (US)

(72) Inventors: Jayesh Rameshlal Jain, The Woodlands, TX (US); Chaitanya K. Vempati, Conroe, TX (US); Gregory L. Ricks, Spring, TX (US); Juan Miguel Bilen, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 308 days.

This patent is subject to a terminal disclaimer.

(21) Appl. No.: 14/973,282

(22) Filed: Dec. 17, 2015

(65) Prior Publication Data

US 2017/0175455 A1 Jun. 22, 2017
US 2018/0179826 A9 Jun. 28, 2018

Related U.S. Application Data

(63) Continuation-in-part of application No. 13/864,926, filed on Apr. 17, 2013, now Pat. No. 9,255,450.

(51) Int. Cl.
*E21B 10/62* (2006.01)
*E21B 7/06* (2006.01)
(Continued)

(52) U.S. Cl.
CPC ..... *E21B 10/62* (2013.01); *E21B 7/064* (2013.01); *E21B 10/20* (2013.01); *E21B 10/42* (2013.01);
(Continued)

(58) Field of Classification Search
CPC .... E21B 10/62; E21B 10/54; E21B 2010/622; E21B 7/064; E21B 10/32; E21B 10/322; E21B 10/325; E21B 10/34; E21B 10/345
See application file for complete search history.

(56) References Cited

U.S. PATENT DOCUMENTS 1,612,338 A 12/1926 Wilson et al.
2,815,932 A * 12/1957 Wolfram ..... E21B 10/66 173/138
(Continued)

FOREIGN PATENT DOCUMENTS

WO 2005097383 A1 10/2005
WO 2009134842 A2 11/2009
WO WO-2017044763 A1 * 3/2017 ..... E21B 10/62

OTHER PUBLICATIONS

Jain, Jayesh Rmeshlal, U.S Appl. No. 14/851,117 entitled Actively Controlled Self-Adjusting Bits and Related Systems and Methods, filed Sep. 11, 2015.
(Continued)

*Primary Examiner* — Jennifer Hawkins Gay
(74) *Attorney, Agent, or Firm* — TraskBritt

(57) ABSTRACT

Earth-boring tools may include a body and a passively adjustable, aggressiveness-modifying member secured to the body. The passively adjustable, aggressiveness-modifying member may be movable between a first position in which the earth-boring tool exhibits a first aggressiveness and a second position in which the earth-boring tool exhibits a second, different aggressiveness responsive to forces acting on the passively adjustable, aggressiveness-modifying member.

17 Claims, 8 Drawing Sheets

(51) Int. Cl.

| | |
|---|---|
| ***E21B 10/54*** | (2006.01) |
| ***E21B 10/20*** | (2006.01) |
| ***E21B 10/42*** | (2006.01) |
| ***E21B 17/10*** | (2006.01) |

(52) U.S. Cl.

CPC ..... *E21B 10/54* (2013.01); *E21B 17/1092* (2013.01); *E21B 2010/622* (2013.01)

(56) References Cited

U.S. PATENT DOCUMENTS

| | | | | |
|---|---|---|---|---|
| 3,050,122 | A | 8/1962 | Huitt | |
| 3,422,672 | A | 1/1969 | Payne | |
| 3,583,501 | A | 6/1971 | Aalund | |
| 4,375,239 | A | 3/1983 | Barrington et al. | |
| 4,386,669 | A | 6/1983 | Evans | |
| 4,662,458 | A | 5/1987 | Ho | |
| 4,856,601 | A | 8/1989 | Raney | |
| 5,042,596 | A | 8/1991 | Brett et al. | |
| 5,553,678 | A * | 9/1996 | Barr | E21B 4/02 175/324 |
| 5,842,149 | A | 11/1998 | Harrell et al. | |
| 5,967,247 | A | 10/1999 | Pessier | |
| 6,021,377 | A | 2/2000 | Dubinsky et al. | |
| 6,123,160 | A | 9/2000 | Tibbitts | |
| 6,142,250 | A * | 11/2000 | Griffin | E21B 7/068 175/381 |
| 6,157,893 | A | 12/2000 | Berger et al. | |
| 6,173,797 | B1 | 1/2001 | Dykstra et al. | |
| 6,253,863 | B1 | 7/2001 | Mensa-Wilmot et al. | |
| 6,349,780 | B1 | 2/2002 | Beuershausen | |
| 6,785,641 | B1 | 8/2004 | Huang | |
| 7,430,153 | B2 | 9/2008 | Fraser et al. | |
| 7,523,792 | B2 | 4/2009 | El-Rayes et al. | |
| 7,721,823 | B2 | 5/2010 | Radford | |
| 7,866,413 | B2 | 1/2011 | Stauffer et al. | |
| 7,921,937 | B2 | 4/2011 | Brackin et al. | |
| 7,971,662 | B2 * | 7/2011 | Beuershausen | E21B 10/62 175/408 |
| 8,061,455 | B2 | 11/2011 | Beuershausen | |
| 8,205,686 | B2 | 6/2012 | Beuershausen | |
| 8,443,875 | B2 | 5/2013 | Lee | |
| 8,739,884 | B2 | 6/2014 | Lake | |
| 8,768,726 | B1 | 7/2014 | Cave | |
| 8,925,654 | B2 | 1/2015 | Zahradnik | |
| 9,080,399 | B2 * | 7/2015 | Oesterberg | E21B 7/064 |
| 9,255,450 | B2 * | 2/2016 | Jain | E21B 10/62 |
| 9,663,995 | B2 * | 5/2017 | Jain | E21B 10/62 |
| 9,708,859 | B2 * | 7/2017 | Jain | E21B 10/62 |
| 2003/0146305 | A1 | 8/2003 | Gurich et al. | |
| 2003/0166470 | A1 | 9/2003 | Fripp et al. | |
| 2005/0096847 | A1 | 5/2005 | Huang | |
| 2007/0114065 | A1 | 5/2007 | Hall | |
| 2007/0221416 | A1 | 9/2007 | Hall et al. | |
| 2007/0272445 | A1 | 11/2007 | Cariveau et al. | |
| 2008/0000693 | A1 * | 1/2008 | Hutton | E21B 7/064 175/61 |
| 2008/0041593 | A1 | 2/2008 | Brown et al. | |
| 2009/0044979 | A1 | 2/2009 | Johnson et al. | |
| 2009/0097985 | A1 | 4/2009 | Lea-Wilson | |
| 2009/0107722 | A1 * | 4/2009 | Chen | E21B 7/064 175/25 |
| 2010/0071956 | A1 | 3/2010 | Beuershausen | |
| 2010/0157735 | A1 | 6/2010 | Allan et al. | |
| 2010/0212964 | A1 * | 8/2010 | Beuershausen | E21B 10/62 175/57 |
| 2010/0270085 | A1 * | 10/2010 | Turner | E21B 10/08 175/381 |
| 2012/0106297 | A1 | 5/2012 | Fraser | |
| 2012/0255788 | A1 * | 10/2012 | Schwefe | E21B 10/62 175/61 |
| 2012/0318580 | A1 * | 12/2012 | Oesterberg | E21B 7/064 175/57 |
| 2013/0025358 | A1 | 1/2013 | Radford et al. | |
| 2013/0081880 | A1 | 4/2013 | Schwefe et al. | |
| 2014/0311801 | A1 * | 10/2014 | Jain | E21B 10/62 175/27 |
| 2014/0332271 | A1 | 11/2014 | Do et al. | |
| 2014/0332283 | A1 | 11/2014 | Do et al. | |
| 2014/0356419 | A1 | 12/2014 | Gujral et al. | |
| 2015/0191979 | A1 * | 7/2015 | Jain | E21B 10/54 175/57 |
| 2016/0032658 | A1 * | 2/2016 | Jain | E21B 10/62 175/27 |
| 2016/0053551 | A1 * | 2/2016 | Jain | E21B 10/54 175/57 |
| 2017/0074047 | A1 * | 3/2017 | Jain | E21B 10/62 |
| 2017/0175454 | A1 * | 6/2017 | Ricks | E21B 10/62 |
| 2017/0175455 | A1 * | 6/2017 | Jain | E21B 10/62 |
| 2017/0268312 | A1 | 9/2017 | Haake | |

OTHER PUBLICATIONS

Jain, Jayesh R., Drill Bit with Self-Adjusting Gage Pads, U.S. Appl. No. 14/516,069, filed Oct. 16, 2014.

Jain et al., Mitigation of Torsional Stick-Slip Vibrations in Oil Well Drilling Through PCD Bit Design: Putting Theories to the Test, SPE 146561, Soiciet of Petroleum Engineers, 2011, pp. 1-13.

Jain et al., Modeling and Simulation of Drill Strings with Adaptive Systems, U.S. Appl. No. 14/516,203 dated Oct. 16, 2014.

Ricks et al., U.S Appl. No. 14/972,635 entitiled Self-Adjusting Earth-Boring Tools and Related Systems and Methods filed Dec. 17, 2015.

International Search Report for International Application No. PCT/US2016/067106 dated May 19, 2017, 7 pages.

International Written Opinion for International Application No. PCT/US2016/067106 dated May 19, 2017, 8 pages.

* cited by examiner

EARTH-BORING TOOLS INCLUDING PASSIVELY ADJUSTABLE, AGGRESSIVENESS-MODIFYING MEMBERS AND RELATED METHODS

CROSS-REFERENCE TO RELATED APPLICATION

This application is a continuation-in-part of U.S. patent application Ser. No. 13/864,926, filed Apr. 17, 2013, now U.S. Pat. No. 9,255,450, issued Feb. 9, 2016, for "DRILL BIT WITH SELF-ADJUSTING PADS," the disclosure of which is incorporated herein in its entirety by this reference.

The subject matter of this application is related to U.S. patent application Ser. No. 14/851,117, filed Sep. 11, 2015, now U.S. Pat. No. 10,041,305, issued Aug. 7, 2018, and to U.S. patent application Ser. No. 14/972,635, filed Dec. 17, 2015, pending.

FIELD

This disclosure relates generally to earth-boring tools and systems that utilize the same for drilling boreholes in earth formations. More specifically, disclosed embodiments relate to earth-boring tools that may include one or more passively adjustable, aggressiveness-modifying members configured to modify the aggressiveness of the earth-boring tools in response to forces acting on the passively adjustable, aggressiveness-modifying members.

BACKGROUND

Oil wells (also referred to as "wellbores" or "boreholes") are drilled with a drill string that includes a tubular member having a drilling assembly (also referred to as the "bottom-hole assembly" or "BHA"). The BHA typically includes devices and sensors that provide information relating to a variety of parameters relating to the drilling operations ("drilling parameters"), behavior of the BHA ("BHA parameters") and parameters relating to the formation surrounding the wellbore ("formation parameters"). An earth-boring tool, such as a drill bit attached to the bottom end of the BHA, is rotated by rotating the drill string and/or by a drilling motor (also referred to as a "mud motor") in the BHA to disintegrate the rock formation to drill the wellbore. A large number of wellbores are drilled along contoured trajectories. For example, a single wellbore may include one or more vertical sections, deviated sections and horizontal sections through differing types of rock formations. When drilling progresses from a soft formation, such as sand, to a hard formation, such as shale, or vice versa, the rate of penetration (ROP) of the drill changes and can cause (decreases or increases) excessive fluctuations or vibration (lateral or torsional) in the earth-boring tool. The ROP is typically controlled by controlling the weight-on-bit (WOB) and rotational speed (revolutions per minute or "RPM") of the drill bit so as to control drill bit fluctuations. The WOB is controlled by controlling the hook load at the surface and the RPM is controlled by controlling the drill string rotation at the surface and/or by controlling the drilling motor speed in the BHA. Controlling the drill bit fluctuations and ROP by such methods requires the drilling system or operator to take actions at the surface. The impact of such surface actions on the drill bit fluctuations is not substantially immediate. Drill bit aggressiveness contributes to the vibration, whirl and stick-slip for a given WOB and drill bit rotational speed. "Depth of Cut" (DOC) of a drill bit, generally defined as "the distance the drill bit advances along axially into the formation in one revolution," is a contributing factor relating to the drill bit aggressiveness. Controlling DOC, cutting element exposure, and other aggressiveness-affecting parameters can provide a smoother borehole, avoid premature damage to the cutters and prolong operating life of the earth-boring tool.

BRIEF SUMMARY

The disclosure herein provides a drill bit and drilling systems using the same configured to control the rate of change of instantaneous aggressiveness of an earth-boring tool during drilling of a wellbore.

In some embodiments, earth-boring tools may include a body and a passively adjustable, aggressiveness-modifying member secured to the body. The passively adjustable, aggressiveness-modifying member may be movable between a first position in which the earth-boring tool exhibits a first aggressiveness and a second position in which the earth-boring tool exhibits a second, different aggressiveness responsive to forces acting on the passively adjustable, aggressiveness-modifying member.

In other embodiments, methods of passively adjusting aggressivenesses of earth-boring tools may involve causing a force to be exerted on a passively adjustable, aggressiveness-modifying member secured to a body. The passively adjustable, aggressiveness-modifying member may move from a first position in which the earth-boring tool exhibits a first aggressiveness to a second position in which the earth-boring tool exhibits a second, different aggressiveness responsive to the force acting on the passively adjustable, aggressiveness-modifying member.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

Figure 1:
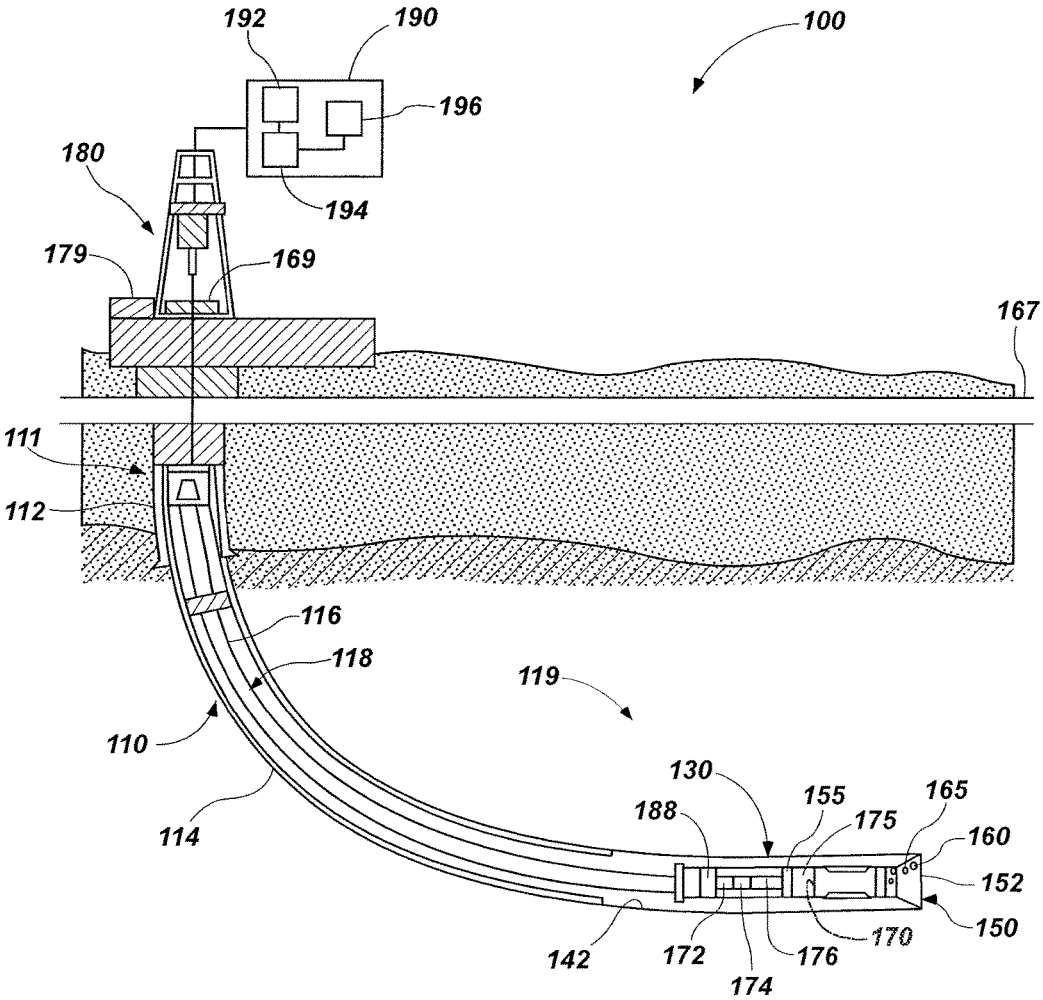
FIG. 1 is a schematic diagram of an illustrative drilling system that includes a drill string that has an earth-boring tool made according to one embodiment of this disclosure.

The illustrations presented in this disclosure are not meant to be actual views of any particular drill string, earth-boring tool, or component thereof, but are merely idealized representations employed to describe illustrative embodiments. Thus, the drawings are not necessarily to scale.

Disclosed embodiments relate generally to earth-boring tools that may include one or more passively adjustable, aggressiveness-modifying members configured to modify the aggressiveness of the earth-boring tools in response to forces acting on the passively adjustable, aggressiveness-modifying members. More specifically, disclosed are embodiments of earth-boring tools that may enable selective increasing and decreasing of the aggressiveness of the earth-boring tools utilizing the forces acting on, and corresponding responsive movement of, passively adjustable, aggressiveness-modifying members secured to the earth-boring tools.

Although some embodiments of passively adjustable, aggressiveness-modifying members in this disclosure are depicted as being used and employed in earth-boring drill bits, such as fixed-cutter earth-boring rotary drill bits, sometimes referred to as "drag" bits, and rolling-cone drill bits, and earth-boring reamers, such as expandable reamers, passively adjustable, aggressiveness-modifying members in accordance with this disclosure may be employed in any earth-boring tool having a cutting structure susceptible to passive adjustment of its aggressiveness. Accordingly, the terms "earth-boring tool" and "earth-boring drill bit," as used in this disclosure, mean and include any type of bit or tool used for drilling during the formation or enlargement of a wellbore in a subterranean formation and include, for example, fixed-cutter drill bits, rolling cone bits, percussion bits, core bits, eccentric bits, bicenter bits, reamers, mills, hybrid bits, and other drilling bits and tools known in the art.

As used in this disclosure, the term "passive" when used in the context of the adjustment of an aggressiveness-modifying member means and includes embodiments wherein the adjustment is achieved without requiring any special-purpose, dedicated electrical or electromechanical actuation components to accomplish adjustment. For example, passively adjustable, aggressiveness-modifying members may lack electronic and electromechanical actuation mechanisms and may not require dedicated operator triggers (e.g., changing flow rates of circulating fluid, changing rates of rotation of the drill string, making such changes in a predetermined pattern) to accomplish or initiate adjustment. As an additional example, passively adjustable, aggressiveness-modifying members may be actuatable utilizing mechanical or hydraulic actuation mechanisms, and may automatically actuate, deactuate, and otherwise modify aggressiveness in response to forces inherently acting on the passively adjustable, aggressiveness-modifying members during use.

As used in this disclosure, the term "aggressiveness" (μ) of an earth-boring tool is calculated according to the following formula:

$$\mu = \frac{36 \times T}{D \times W}$$

wherein T is the torque applied to the earth-boring tool, D is the diameter of the earth-boring tool, and W is the weight applied to the earth-boring tool (e.g., weight-on-bit (WOB)). Aggressiveness is a unitless number. Aggressiveness may be affected by factors such as vibration, number of blades or cones, cutting element size, type, and configuration, hardness of the subterranean formation, etc. These factors may affect the aggressiveness by changing the torque delivered at a particular applied weight. Different types of earth-boring tools may exhibit different aggressivenesses. As illustrative examples, conventional roller cone bits may have a bit aggressiveness of from about 0.10 to about 0.25, impregnated bits may have a bit aggressiveness of from about 0.12 to about 0.40, and fixed-cutter bits may have a bit aggressiveness of from about 0.40 to about 1.50 (assuming, in each case, similar cutting element type on each blade or roller cone of a bit, and somewhat evenly distributed applied weight between each blade or roller cone). Hybrid bits (bits having a combination of roller cones and fixed-cutter blades) may have a bit aggressiveness between that of a roller cone bit and a fixed-cutter drill bit.

FIG. 1 is a schematic diagram of an illustrative drilling system 100 that may utilize earth-boring tools made according to the disclosure herein. FIG. 1 shows a wellbore 110 having an upper section 111 with a casing 112 installed therein and a lower section 114 being drilled with a drill string 118. The drill string 118 is shown to include a tubular member 116 with a BHA 130 attached at its bottom end. The tubular member 116 may be made up by joining drill pipe sections or it may be a coiled-tubing. An earth-boring tool 150 is shown attached to the bottom end of the BHA 130 for disintegrating the rock formation 119 to drill the wellbore 110 of a selected diameter.

Drill string 118 is shown conveyed into the wellbore 110 by a rig 180 at the surface 167. The illustrative rig 180 shown is a land rig for ease of explanation. The apparatus and methods disclosed herein may also be utilized with an offshore rig used for drilling wellbores under water. A rotary table 169 or a top drive (not shown) coupled to the drill string 118 may be utilized to rotate the drill string 118 to rotate the BHA 130 and thus the earth-boring tool 150 to drill the wellbore 110. A drilling motor 155 (also referred to as the "mud motor") may be provided in the BHA 130 to rotate the earth-boring tool 150. The drilling motor 155 may be used alone to rotate the earth-boring tool 150 or to superimpose the rotation of the earth-boring tool 150 by the drill string 118. A control unit (or controller) 190, which may be a computer-based unit, may be placed at the surface 167 to receive and process data transmitted by the sensors in the earth-boring tool 150 and the sensors in the BHA 130, and to control selected operations of the various devices and sensors in the BHA 130. The surface controller 190, in one embodiment, may include a processor 192, a data storage device (or a computer-readable medium) 194 for storing data, algorithms and computer programs 196. The data storage device 194 may be any suitable device, including, but not limited to, a read-only memory (ROM), a random-access memory (RAM), a flash memory, a magnetic tape, a hard disk and an optical disk. During drilling, a drilling fluid 179 from a source thereof is pumped under pressure into the tubular member 116. The drilling fluid discharges at the bottom of the earth-boring tool 150 and returns to the surface via the annular space (also referred as the "annulus") between the drill string 118 and the inside wall 142 of the wellbore 110.

The BHA 130 may further include one or more downhole sensors (collectively designated by numeral 175). The sensors 175 may include any number and type of sensors, including, but not limited to, sensors generally known as the measurement-while-drilling (MWD) sensors or the logging-while-drilling (LWD) sensors, and sensors that provide information relating to the behavior of the BHA 130, such as drill bit rotation (revolutions per minute or "RPM"), tool face, pressure, vibration, whirl, bending, and stick-slip. The BHA 130 may further include a control unit (or controller) 170 that controls the operation of one or more devices and sensors in the BHA 130. The controller 170 may include, among other things, circuits to process the signals from sensor 175, a processor 172 (such as a microprocessor) to process the digitized signals, a data storage device 174 (such as a solid-state-memory), and a computer program 176. The processor 172 may process the digitized signals, and control downhole devices and sensors, and communicate data information with the controller 190 via a two-way telemetry unit 188.

Still referring to FIG. 1, the earth-boring tool 150 may include a face section (or bottom section) 152. The face section 152 or a portion thereof faces the formation in front of the earth-boring tool 150 or the wellbore bottom during drilling. The earth-boring tool 150, in one aspect, includes one or more passively adjustable, aggressiveness-modifying members 160 that may be extended and retracted from a selected surface of the earth-boring tool 150 to passively adjust an aggressiveness of the earth-boring tool 150. The passively adjustable, aggressiveness-modifying members 160 may also be referred to as "pads," "extensible pads," "extendable pads," "adjustable pads," "adjustable gage pads," "adjustable cutting elements," "adjustable cutters," "adjustable inserts," "adjustable ovoids," "adjustable legs," and "adjustable depth-of-cut controlling devices," depending on where they are located, which type of earth-boring tool they are secured to, and the particular configuration they employ. A suitable actuation device (or actuation unit) 165 in the earth-boring tool 150 may be utilized to extend and retract one or more passively adjustable, aggressiveness-modifying members 160 from a surface of the earth-boring tool 150 during drilling (e.g., formation or enlargement) of the wellbore 110. In one aspect, the actuation device 165 may control the rate of extension and retraction of the passively adjustable, aggressiveness-modifying members 160. The actuation device 165 is also referred to as a "rate control device" or "rate controller." In another aspect, the actuation device 165 is a passive device that automatically adjusts or self-adjusts the extension and retraction of the passively adjustable, aggressiveness-modifying members 160 based on, or in response to, the force or pressure applied to the passively adjustable, aggressiveness-modifying members 160 during drilling. The rate of extension and retraction of the passively adjustable, aggressiveness-modifying members 160 may be preset as described in more detail in reference to FIGS. 2 through 4.

Figure 2:
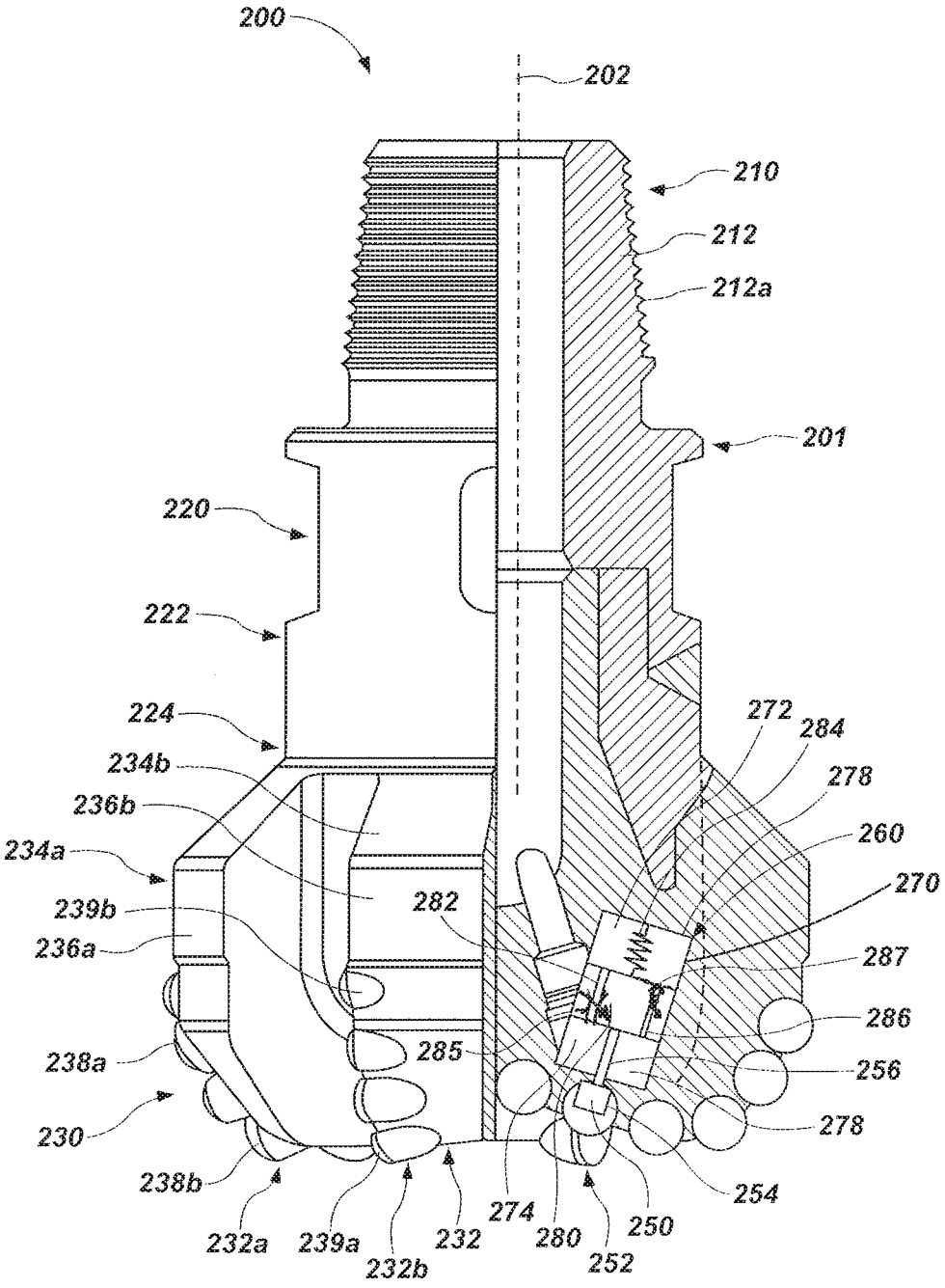
FIG. 2 shows a partially cut-away side view of an illustrative earth-boring tool configured as a fixed-cutter drill bit with a passively adjustable, aggressiveness-modifying member and a rate control device for controlling the rates of extending and retracting the passively adjustable, aggressiveness-modifying member from a surface of the earth-boring tool, according to one embodiment of this disclosure.

FIG. 2 shows an illustrative earth-boring tool 200 made according to one embodiment of this disclosure. The earth-boring tool 200 is a polycrystalline diamond compact (PDC), fixed-cutter bit having a body 201 that includes a neck or neck section 210, a shank 220, and a crown or crown section 230. The neck 210 has a tapered upper end 212 having threads 212*a* thereon for connecting the earth-boring tool 200 to a box end of the drilling assembly 130 (FIG. 1). The shank 220 has a lower vertical or straight section 222 that is fixedly connected to the crown 230 at a joint 224. The crown 230 includes a face or face section 232 that faces the formation during drilling. The crown 230 includes a number of blades, such as blades 234*a*, 234*b*, etc. A typical PDC bit may include, for example, from three to seven blades. Each blade has a face (also referred to as a "face section") and a side (also referred to as a "side section"). For example, blade 234*a* has a face 232*a* and a side 236*a*, while blade 234*b* has a face 232*b* and a side 236*b*. The sides 236*a* and 236*b* extend along the longitudinal or vertical axis 202 (e.g., an axis of rotation) of the earth-boring tool 200. Each blade further may further include a number of cutters secured thereto. In the particular embodiment of FIG. 2, blade 234*a* is shown to include cutters 238*a* on a portion of the side 236*a* and cutters 238*b* along the face 232*a* while blade 234*b* is shown to include cutters 239*a* on the side 236*b* and cutters 239*b* on the face 232*b*.

Still referring to FIG. 2, the earth-boring tool 200 includes one or more passively adjustable, aggressiveness-modifying members 250 that extend and retract from a surface 252 of the earth-boring tool 200. FIG. 2 shows a passively adjustable, aggressiveness-modifying member 250 movably placed in a cavity or recess 254 in the crown section 230. As shown in FIG. 2, the passively adjustable, aggressiveness-modifying member 250 may be configured as, for example, a pad or depth-of-cut control device configured to modify a depth of cut of the cutters 238. An activation device 260 may be coupled to the passively adjustable, aggressiveness-modifying member 250 to extend and retract the passively adjustable, aggressiveness-modifying member 250 from a surface location 252 on the earth-boring tool 200.

In one aspect, the activation device 260 controls the rate of extension and retraction of the passively adjustable, aggressiveness-modifying member 250. In another aspect, the device 260 extends the passively adjustable, aggressiveness-modifying member 250 at a first rate and retracts the passively adjustable, aggressiveness-modifying member 250 at a second rate. In embodiments, the first rate and second rate may be the same or different rates. In another aspect, the rate of extension of the passively adjustable, aggressiveness-modifying member 250 may be greater than the rate of retraction As noted above, the device 260 also is referred to herein as a "rate control device" or a "rate controller." In the particular embodiment of the device 260, the passively adjustable, aggressiveness-modifying member 250 is directly coupled to the device 260 via a mechanical connection or connecting member 256.

In one aspect, the device 260 includes a chamber 270 that houses a double acting reciprocating member, such as a piston 280, that sealingly divides the chamber 270 into a first chamber 272 and a second chamber 274. Both chambers 272 and 274 are filled with a hydraulic fluid 278 suitable for downhole use, such as oil. A biasing member, such as a spring 284, in the first chamber 272, applies a selected force on the piston 280 to cause it to move outward. Since the piston 280 is connected to the passively adjustable, aggressiveness-modifying member 250, moving the piston outward causes the passively adjustable, aggressiveness-modifying member 250 to extend from the surface 252 of the earth-boring tool 200. In one aspect, the chambers 272 and 274 are in fluid communication with each other via a first fluid flow path or flow line 282 and a second fluid flow path or flow line 286. A flow control device, such as a flow restrictor 285 (e.g., an orifice plate), a check valve, or a flow restrictor 285 and a check valve, placed in the fluid flow line 282, may be utilized to control the rate of flow of the fluid from chamber 274 to chamber 272. Similarly, another flow control device, such as a check valve 287, a flow restrictor, or a check valve 287 and a flow restrictor, placed in fluid flow line 286, may be utilized to control the rate of flow of the fluid 278 from chamber 272 to chamber 274. The flow control devices 285 and 287 may be configured at the surface to set the rates of flow through fluid flow lines 282 and 286, respectively.

In one aspect, one or both flow control devices 285 and 287 may include a variable control, biasing device, such as a spring, to provide a constant flow rate from one chamber to another. Constant fluid flow rate exchange between the chambers 272 and 274 provides a first constant rate for the extension for the piston 280 and a second constant rate for the retraction of the piston 280 and, thus, corresponding constant rates for extension and retraction of the passively adjustable, aggressiveness-modifying member 250. The size of the flow control lines 282 and 286 along with the setting of their corresponding biasing devices 285 and 287 define the flow rates through lines 282 and 286, respectively, and thus the corresponding rate of extension and retraction of the passively adjustable, aggressiveness-modifying member 250. In one aspect, the fluid flow line 282 and its corresponding flow control device 285 may be set such that when the earth-boring tool 200 is not in use, i.e., there is no external force being applied onto the passively adjustable, aggressiveness-modifying member 250, the biasing member 284 will extend the passively adjustable, aggressiveness-modifying member 250 to the maximum extended position. In one aspect, the flow control line 282 may be configured so that the biasing member 284 extends the passively adjustable, aggressiveness-modifying member 250 relatively fast or suddenly. When the earth-boring tool 200 is in operation, such as during drilling of a wellbore, the weight applied to the earth-boring tool 200 may exert an external force on the passively adjustable, aggressiveness-modifying member 250. This external force may cause the passively adjustable, aggressiveness-modifying member 250 to apply a force or pressure on the piston 280 and thus on the biasing member 284.

In one aspect, the fluid flow line 286 may be configured to allow relatively slow flow rate of the fluid from chamber 272 into chamber 274, thereby causing the passively adjustable, aggressiveness-modifying member 250 to retract relatively slowly. As an example, the extension rate of the passively adjustable, aggressiveness-modifying member 250 may be set so that the passively adjustable, aggressiveness-modifying member 250 extends from the fully retracted position to a fully extended position over a few seconds while it retracts from the fully extended position to the fully retracted position over one or several minutes or longer (such as, for example, between two and five minutes). It will be noted that any suitable rate may be set for the extension and retraction of the passively adjustable, aggressiveness-modifying member 250. In one aspect, the device 260 is a passive device that adjusts the extension and retraction of a passively adjustable, aggressiveness-modifying member 250 based on or in response to the force or pressure applied on the passively adjustable, aggressiveness-modifying member 250.

When the passively adjustable, aggressiveness-modifying member 250 is in a first state, the earth-boring tool 200 may exhibit a first aggressiveness, and the earth-boring tool 200 may exhibit a second, different aggressiveness when the passively adjustable, aggressiveness-modifying member 250 is in a second state. For example, when the passively adjustable, aggressiveness-modifying member 250 is in a fully extended position, the earth-boring tool 200 may exhibit a least aggressiveness, and the earth-boring tool may exhibit a greatest aggressiveness when the passively adjustable, aggressiveness-modifying member 250 is in a fully retracted position. Moreover, the passively adjustable, aggressiveness-modifying member 250 may automatically adapt the aggressiveness of the earth-boring tool 200 responsive to forces inherently acting on the passively adjustable, aggressiveness-modifying member 250 (e.g., applied weight, vibrational forces, reaction forces from the formation, applied torque) to and between the greatest and least aggressivenesses, enabling the earth-boring tool 200 to adaptively react to drilling conditions without requiring active intervention from an operator or complex, active adjustment-controlling mechanisms.

The passively adjustable, aggressiveness-modifying member 250 may enable the earth-boring tool 200 to effectively drill the earth formation at lower applied torque for a given applied weight (e.g., weight on bit (WOB)). For example, the passively adjustable, aggressiveness-modifying member 250 may enable a 5% reduction in applied torque for a given applied weight or more. More specifically, the passively adjustable, aggressiveness-modifying member 250 may enable, for example, a 10% reduction in applied torque for a given applied weight or more. As specific, nonlimiting examples, the passively adjustable, aggressiveness-modifying member 250 may enable a 15%, 25%, 30%, 50%, or 60% reduction in applied torque for a given applied weight or more.

Figure 3:
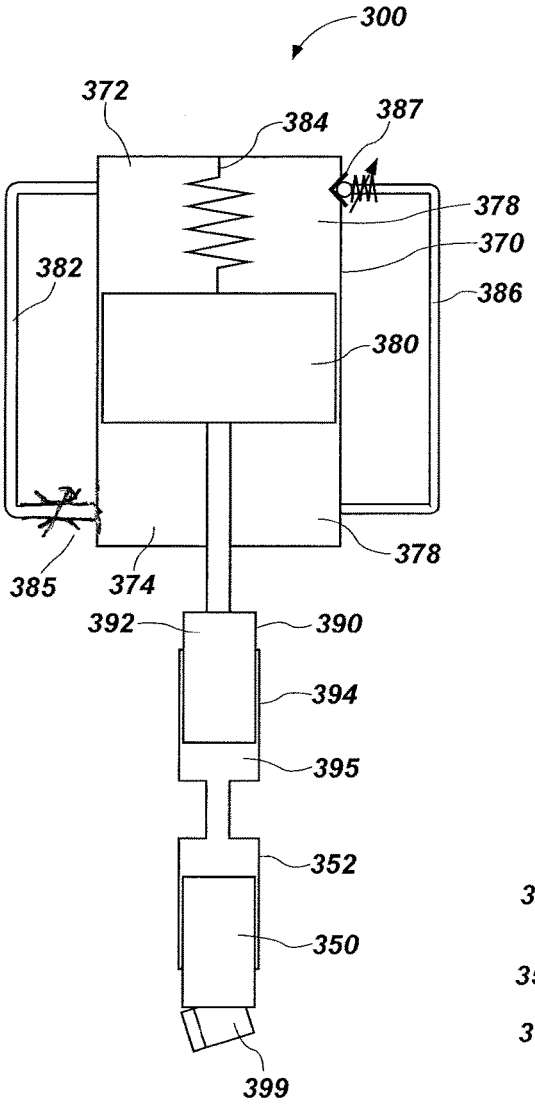
FIG. 3 shows an alternative embodiment of the rate control device that operates the passively adjustable, aggressiveness-modifying member via a hydraulic line.

FIG. 3 shows an another embodiment of a rate control device 300. The device 300 includes a fluid chamber 370 divided by a double acting piston 380 into a first chamber 372 and a second chamber 374. The chambers 372 and 374 are filled with a hydraulic fluid 378. A first fluid flow line 382 and an associated flow control device 385 allow the fluid 378 to flow from chamber 374 to chamber 372 at a first flow rate and a fluid flow line 386 and an associated flow control device 387 allow the fluid 378 to flow from the chamber 372 to chamber 374 at a second rate. The piston 380 is connected to a force transfer device 390 that includes a piston 392 in a chamber 394. The chamber 394 contains a hydraulic fluid 395, which is in fluid communication with a passively adjustable, aggressiveness-modifying member 350. In one aspect, the passively adjustable, aggressiveness-modifying member 350 may be placed in a chamber 352, which chamber is in fluid communication with the fluid 395 in chamber 394. When the biasing device 384 moves the piston 380 outward, it moves the piston 392 outward and into the chamber 394. Piston 392 expels fluid 395 from chamber 394 into the chamber 352, which extends the passively adjustable, aggressiveness-modifying member 350. When a force is applied on to the passively adjustable, aggressiveness-modifying member 350, it pushes the fluid from chamber 352 into chamber 394, which applies a force onto the piston 380. The rate of the movement of the piston 380 is controlled by the flow of the fluid through the fluid flow line 386 and flow control device 387.

In the particular configuration shown in FIG. 3, the rate control device 300 is not directly connected to the passively adjustable, aggressiveness-modifying member 350, which enables isolation of the device 300 from the passively adjustable, aggressiveness-modifying member 350 and allows it to be located at any desired location in the earth-boring tool, as described in connection with FIGS. 5 and 6. In another aspect, the passively adjustable, aggressiveness-modifying member 350 may be directly connected to a cutter 399 or an end of the passively adjustable, aggressiveness-modifying member 350 may be made as a cutter. In this configuration, the cutter 399 acts both as a cutter and an extendable and a retractable, passively adjustable, aggressiveness-modifying member 350.

Figure 4:
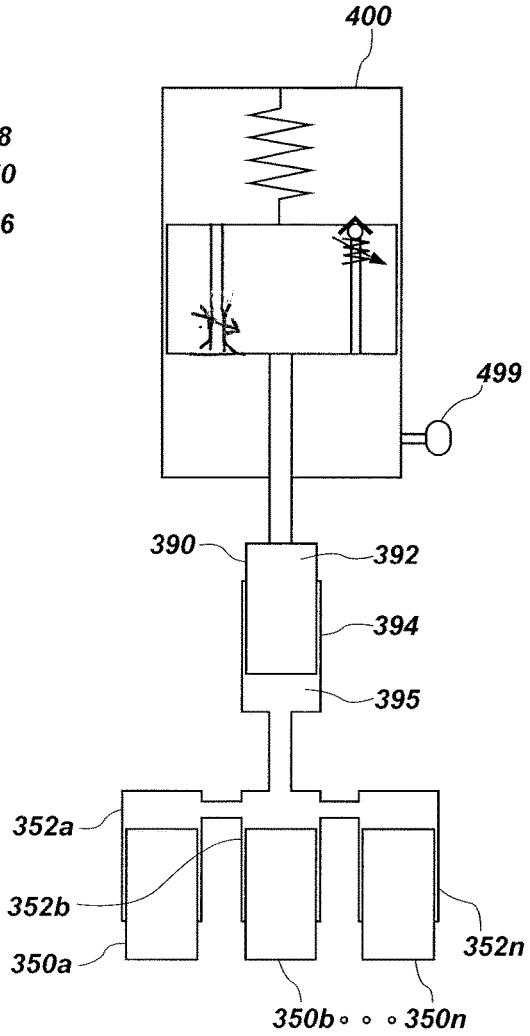
FIG. 4 shows an embodiment of a rate control device configured to operate multiple passively adjustable, aggressiveness-modifying members.

FIG. 4 shows a shared rate control device 400 configured to operate more than one passively adjustable, aggressiveness-modifying member, such as passively adjustable, aggressiveness-modifying members 350*a*, 350*b*, . . . 350*n*. The rate control device 400 is the same as shown and described in FIG. 2, except that it is shown to apply force onto the passively adjustable, aggressiveness-modifying members 350*a*, 350*b*, . . . 350*n* via an intermediate device 390, as shown and described in reference to FIG. 3. In the embodiment of FIG. 4, each of the passively adjustable, aggressiveness-modifying members 350*a*, 350*b* . . . 350*n* is housed in separate chambers 352*a*, 352*b* . . . 352*n*, respectively. The fluid 395 from chamber 394 is supplied to all chambers 352*a*, 352*b* . . . 352*n*, thereby automatically and simultaneously extending and retracting each of the passively adjustable, aggressiveness-modifying members 350*a*, 350*b* . . . 350*n* based on external forces applied to each such passively adjustable, aggressiveness-modifying members 350*a*, 350*b* . . . 350*n* during drilling. In aspects, the rate control device 400 may include a suitable pressure compensator 499 for downhole use. Similarly any of the rate controllers made according to any of the embodiments may employ a suitable pressure compensator.

Figure 5:
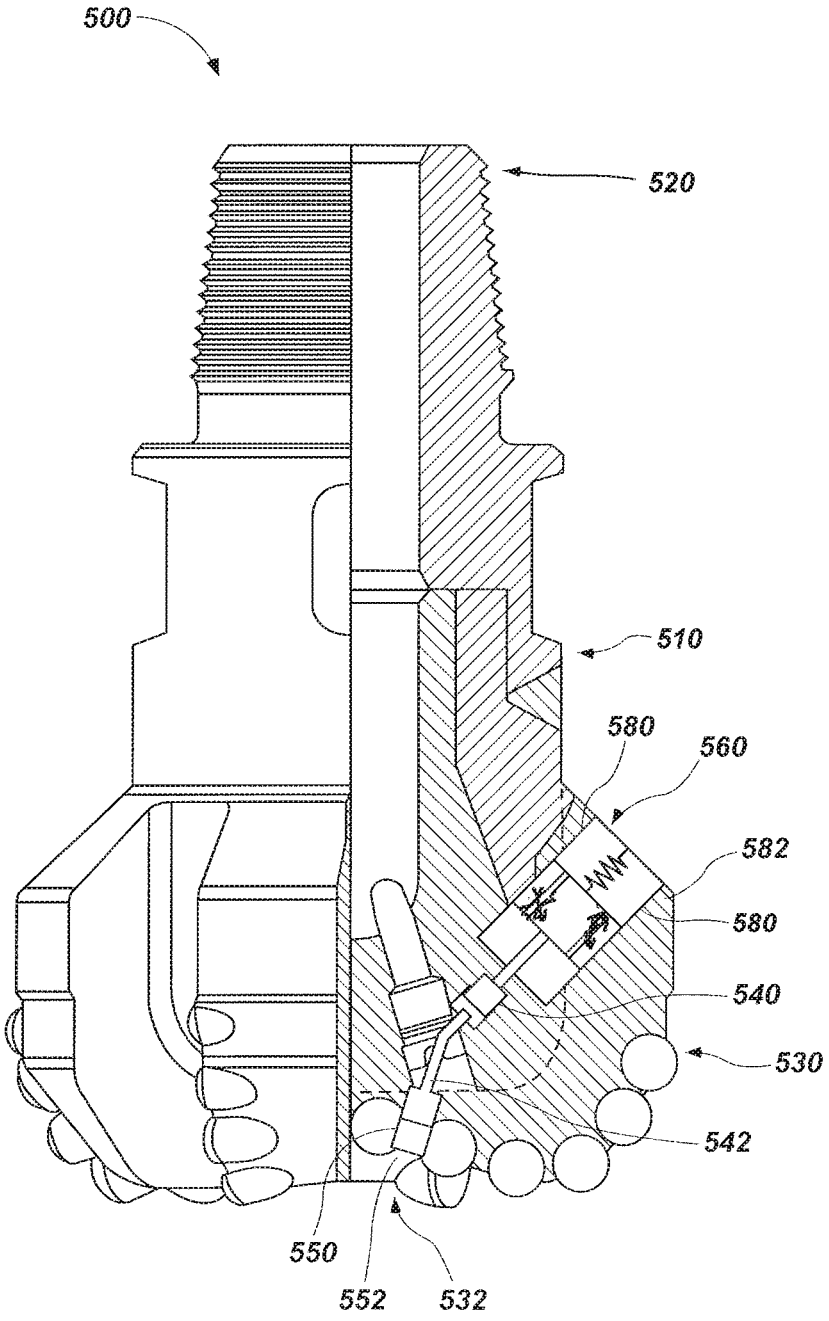
FIG. 5 shows placement of a rate control device of FIG. 4 in the crown section of the earth-boring tool.

FIG. 5 shows an isometric view of an earth-boring tool 500, wherein a rate control device 560 is placed in a crown section 530 of the earth-boring tool 500. The rate control device 560 is the same as shown in FIG. 2, but is coupled to a passively adjustable, aggressiveness-modifying member 550 via a hydraulic connection 540 and a fluid line 542. The rate control device 560 is shown placed in a recess 580 accessible from an outside surface 582 of the crown section 530. The passively adjustable, aggressiveness-modifying member 550 is shown placed at a face location section 552 on the face 532, while the hydraulic connection 540 is shown placed in the crown section 530 between the passively adjustable, aggressiveness-modifying member 550 and the rate control device 560. It should be noted that the rate control device 560 may be placed at any desired location in the earth-boring tool 500, including in the shank 520 and neck section 510 and the hydraulic line 542 may be routed in any desired manner from the rate control device 560 to the passively adjustable, aggressiveness-modifying member 550. Such a configuration provides flexibility of placing the rate control device 560 substantially anywhere in the earth-boring tool 500.

Figure 6:
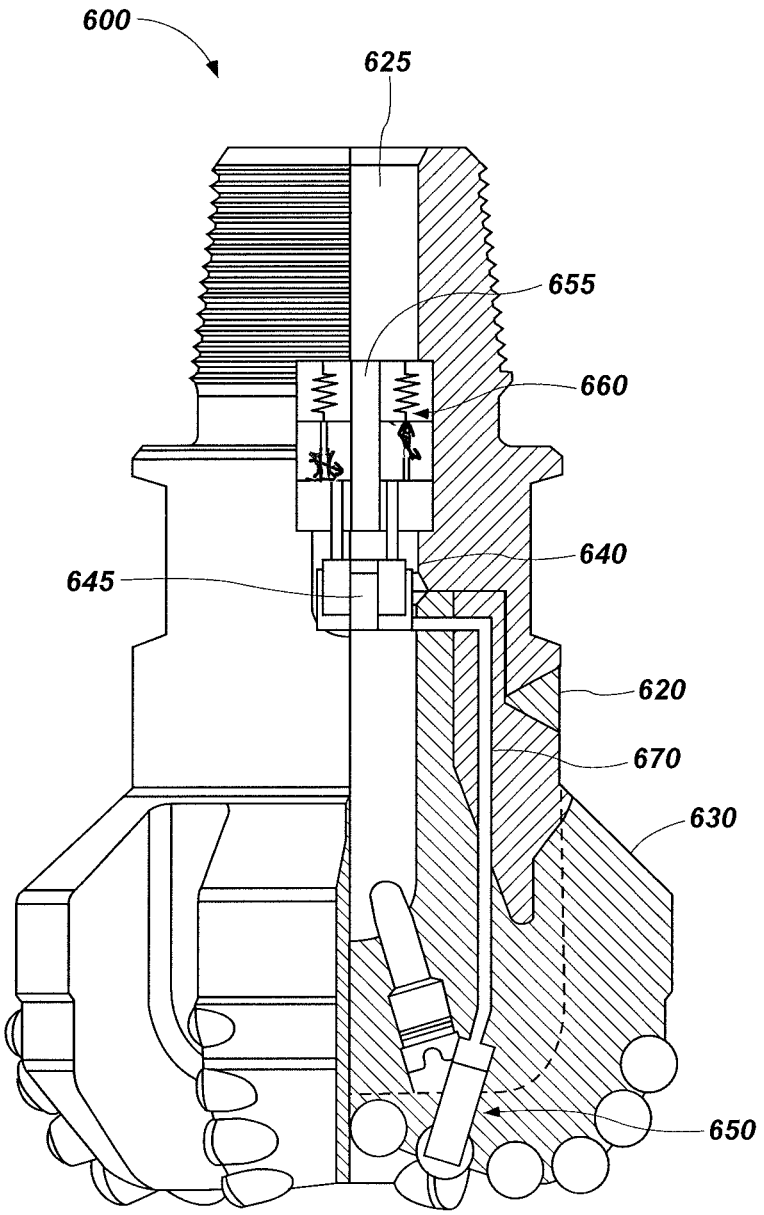
FIG. 6 shows placement of a rate control device of in a fluid passage or flow path of the earth-boring tool.

FIG. 6 shows an isometric view of a earth-boring tool 600, wherein a rate control device 660 is placed in a fluid passage 625 of the earth-boring tool 600. In the particular tool configuration of FIG. 6, the hydraulic connection 640 is placed proximate the rate control device 660. A hydraulic line 670 is run from the hydraulic connection 640 to the passively adjustable, aggressiveness-modifying member 650 through the shank 620 and the crown 630 of the earth-boring tool 600. During drilling, a drilling fluid flows through the passage 625. To enable the drilling fluid to flow freely through the passage 625, the rate control device 660 may be provided with a through bore or passage 655 and the hydraulic connection device 640 may be provided with a flow passage 645.

Figure 7:
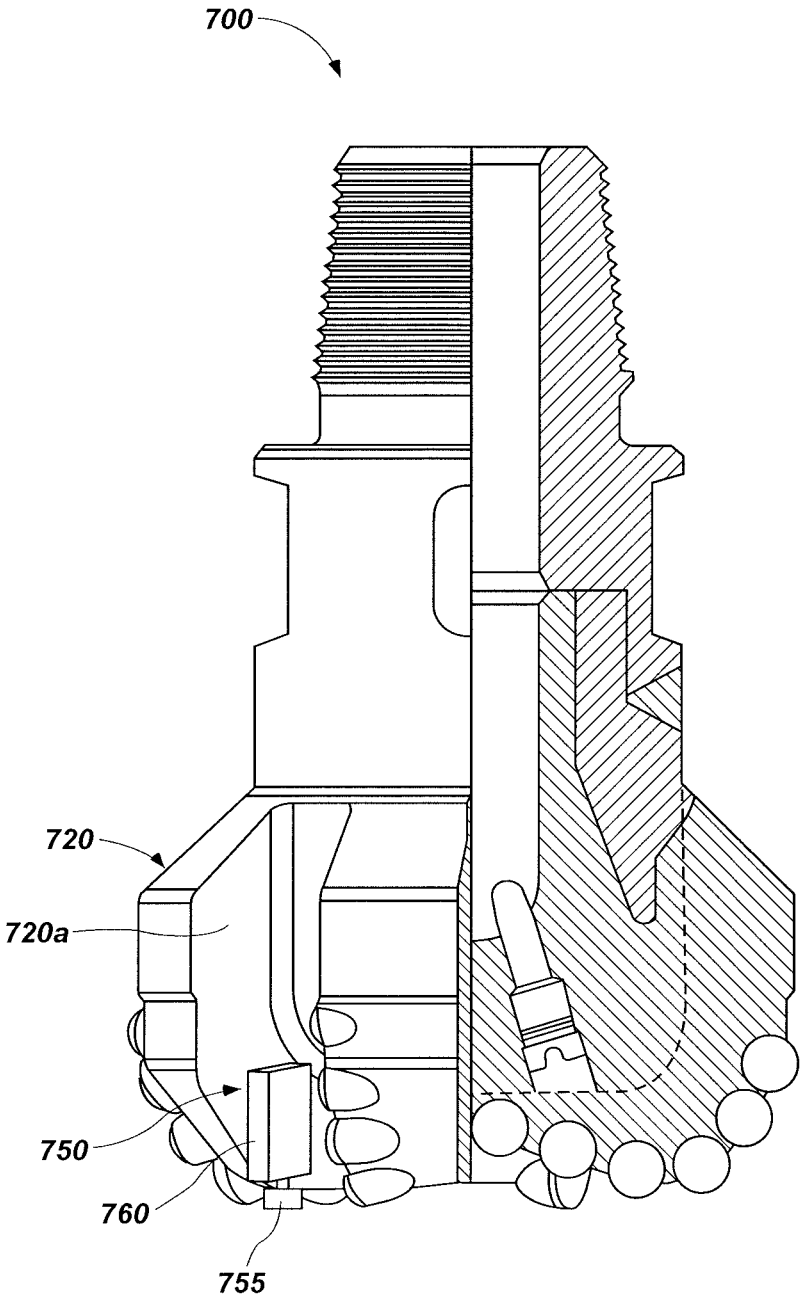
FIG. 7 shows a drill bit, wherein the rate control device and the passively adjustable, aggressiveness-modifying member are placed on an outside surface of the earth-boring tool.

FIG. 7 shows an earth-boring tool 700, wherein an integrated passively adjustable, aggressiveness-modifying member 755 and rate control device 750 is placed on an outside surface of the earth-boring tool 700. In one aspect, the device 750 includes a rate control device 760 connected to a passively adjustable, aggressiveness-modifying member 755. In one aspect, the device 750 is a sealed unit that may be attached to any outside surface of the earth-boring tool 700. The rate control device 760 may be the same as or different from the rate control devices described herein in connection with FIGS. 2 through 6. In the particular embodiment of FIG. 7, the passively adjustable, aggressiveness-modifying member 755 is shown connected to a side 720*a* of a blade 720 of the earth-boring tool 700. The device 750 may be attached or placed at any other suitable location in the earth-boring tool 700. Alternatively or in addition thereto, the device 750 may be integrated into a blade so that the passively adjustable, aggressiveness-modifying member 755 will extend toward a desired direction from the earth-boring tool 700.

Figure 8:
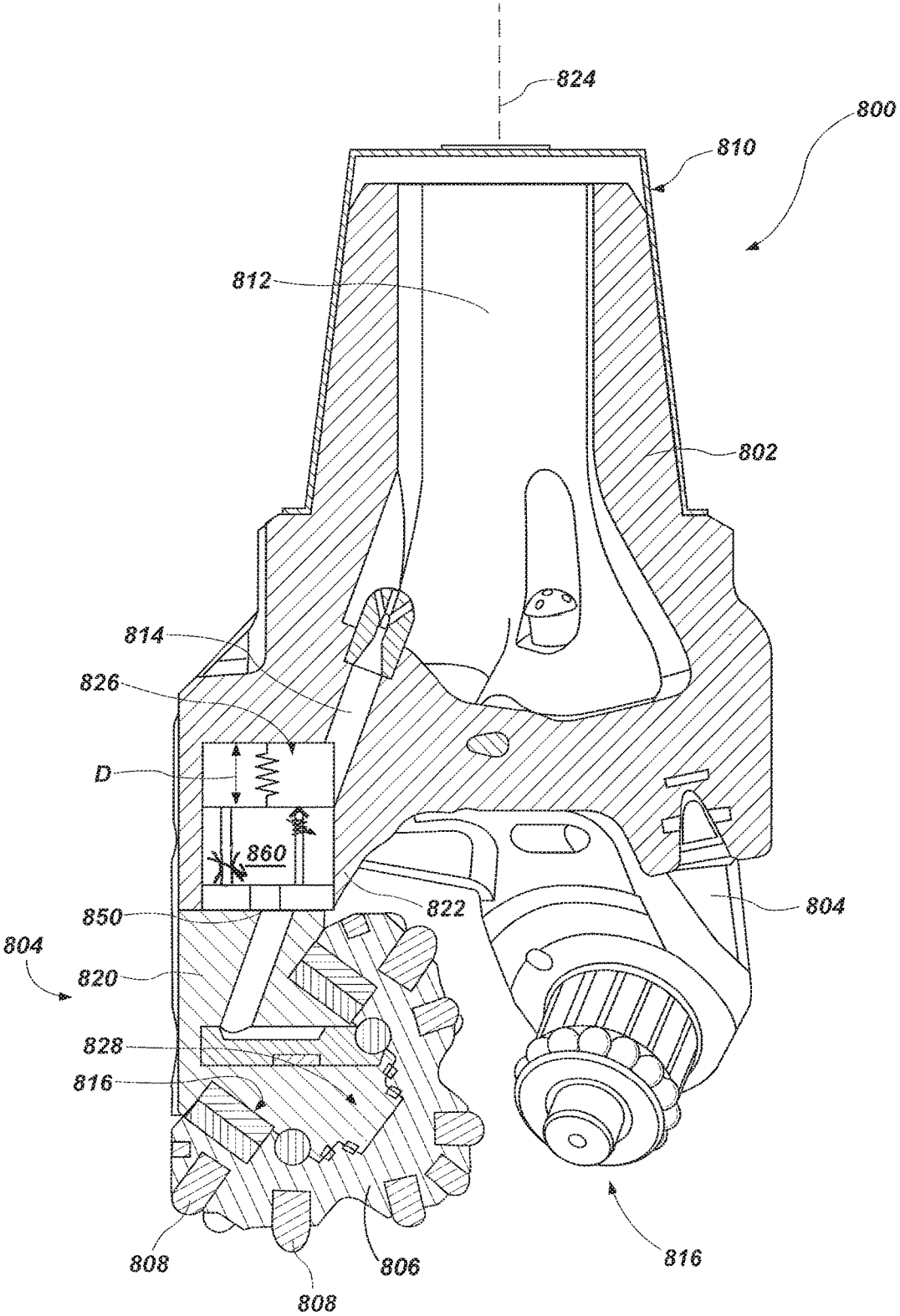
FIG. 8 is a cross-sectional view of another embodiment of an earth-boring tool configured as a rolling cone drill bit including a passively adjustable, aggressiveness-modifying member.

FIG. 8 is a cross-sectional view of another embodiment of an earth-boring tool 800 including a passively adjustable, aggressiveness-modifying member 850. The earth-boring tool 800, depicted as a roller cone bit, includes a body 802 having three legs 804 depending from the body 802. A roller cone 806 is rotatably mounted to a bearing pin 816 on each of the legs 804. Each roller cone 806 may comprise a plurality of cutters 808 (e.g., teeth or inserts) thereon. The earth-boring tool 800 includes a threaded section 810 at its upper end for connection a drill string 118 (see FIG. 1). The earth-boring tool 800 may include an internal plenum 812 extending through the body 802 to fluid passageways 814 that extend from the plenum 812 to a bearing system 828 enabling the roller cones 806 to rotate about the bearing pin 816 as they engage with an underlying earth formation.

The passively adjustable, aggressiveness modifying member 850 may be integrated into one or more of the legs 804 of the earth-boring tool 800, such that each leg 804 including a passively adjustable, aggressiveness modifying member 850 may be movable with respect to the body 802. For example, the passively adjustable, aggressiveness modifying member 850 may include a bottom portion 820 of the leg 804, proximate the bearing pin 816 and separated from the body 802 by an upper portion 822 of the leg 804. The bottom portion 820 of the leg 804 may be movable in a direction D at least substantially parallel to a longitudinal axis 824 (e.g., an axis of rotation) of the earth-boring tool 800. The upper portion 822 of the leg 804 may include a recess 826 extending into the leg 804 toward the body 802, the recess 826 being sized and shaped to receive a rate control device 860 therein. The rate control device 860 may be the same as, or different from, the rate control devices described herein in connection with FIGS. 2 through 7.

When the earth-boring tool 800 is deployed in a borehole, the passively adjustable, aggressiveness modifying member 850 may move between a first, fully extended state and a second, fully retracted state in response to forces acting on the passively adjustable, aggressiveness modifying member 850. For example, the passively adjustable, aggressiveness modifying member 850 may dampen vibrations experienced by the earth-boring tool 800 by moving between a first, lowest longitudinal position along the longitudinal axis 824 and second, highest longitudinal position along the longitudinal axis 824, dampening vibration experienced by the earth-boring tool 800.

Figure 9:
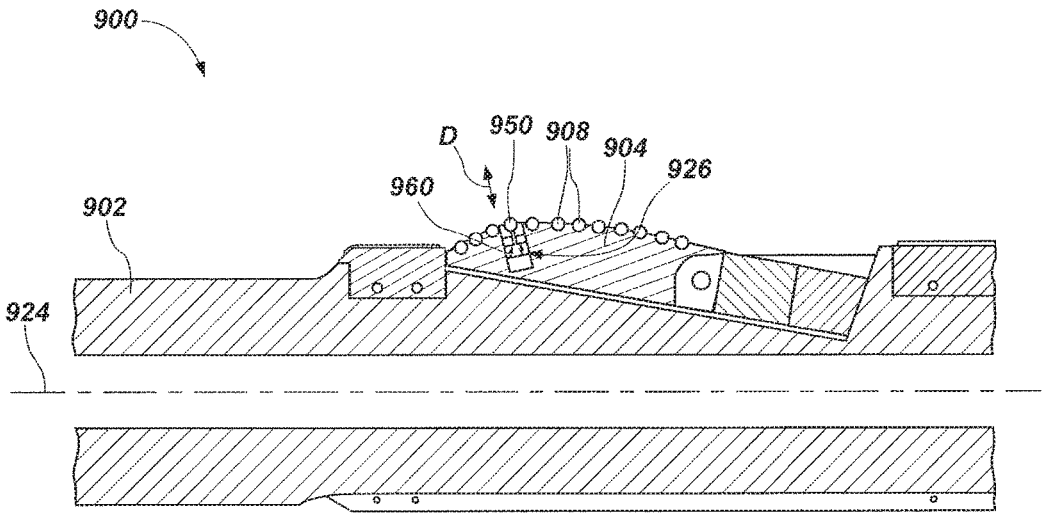
FIG. 9 is a cross-sectional view of a portion of another embodiment of an earth-boring tool configured as an expandable reamer including a passively adjustable, aggressiveness-modifying member.

FIG. 9 is a cross-sectional view of a portion of another embodiment of an earth-boring tool 900 including a passively adjustable, aggressiveness-modifying member 950. The earth-boring tool 900, depicted in FIG. 9 as an expandable reamer, may include sliding blades 904 positionally retained in a circumferentially spaced relationship in a generally cylindrical tubular body 902 of the earth-boring tool. Each blade 904 may include cutters 908 secured thereto, the cutters 908 being configured to engage with, and remove earth material from, a sidewall of a borehole. The blades 904 are movable relative to the tubular body 902 during use of the earth-boring tool 900 between a retracted position and an extended position responsive to application of hydraulic pressure.

The passively adjustable, aggressiveness modifying member 950 may be configured as one or more of the cutters 908 (e.g., PDC cutting elements, impregnated inserts, or inserts of wear resistant material (e.g., metal-matrix-cemented tungsten carbide)) of the earth-boring tool 900. A passively adjustable, aggressiveness modifying member 950 may be included on each blade 904 in some embodiments. In other embodiments, a passively adjustable, aggressiveness-modifying member may be secured to fewer than all blades 904 of the earth-boring tool 900. The passively adjustable, aggressiveness modifying member 950 may be movable in a direction D oriented perpendicular to, or at an oblique angle relative to, a longitudinal axis 924 (e.g., an axis of rotation) of the earth-boring tool 900. The blade 904 may include a recess 926 extending into the blade 904 toward the body 902, the recess 926 being sized and shaped to receive a rate control device 960 therein. The rate control device 960 may be the same as, or different from, the rate control devices described herein in connection with FIGS. 2 through 8.

When the earth-boring tool 900 is deployed in a borehole, the passively adjustable, aggressiveness modifying member 950 may move between a first, fully extended state and a second, fully retracted state in response to forces acting on the passively adjustable, aggressiveness modifying member 950. For example, the passively adjustable, aggressiveness modifying member 950 may transition between an overexposed and an underexposed state relative to the other cutters 908 by moving between a first, outermost radial position from the longitudinal axis 924 and second, innermost radial position from the longitudinal axis 924, responsive to lateral forces from the sidewall of the borehole.

Thus, in various embodiments, a rate controller may be a hydraulic actuation device and may be placed at any desired location in the earth-boring tool or outside the earth-boring tool to self-adjust extension and retraction of one or more passively adjustable, aggressiveness-modifying members based on or in response to external forces applied on the passively adjustable, aggressiveness-modifying members during drilling of a wellbore. The passively adjustable, aggressiveness-modifying members may be located and oriented independently from the location and/or orientation of the rate controller in the earth-boring tool. Multiple passively adjustable, aggressiveness-modifying members may be inter-connected and activated simultaneously. Multiple passively adjustable, aggressiveness-modifying members may also be connected to a shared rate controller.

In various embodiments, during stick-slip, the passively adjustable, aggressiveness-modifying members can extend relatively quickly at high rotational speed (RPM) of the earth-boring tool when the depth of cut (DOC) of the cutters is low. However, at low RPM, when the DOC starts increasing suddenly, the pads resist sudden inward motion and create a large contact (rubbing) force preventing high DOC. Limiting high DOC during stick-slip reduces the high torque build-up and mitigates stick-slip. In various embodiments, the rate controller may allow sudden or substantially sudden extension (outward motion) of a passively adjustable, aggressiveness-modifying member and limit sudden retraction (inward motion) of the passively adjustable, aggressiveness-modifying member. Such a mechanism may prevent sudden increase in the depth of cut of cutters during drilling. A pressure compensator may be provided to balance the pressures inside and outside the cylinder of the rate controller.

Additional, nonlimiting embodiments within the scope of this disclosure follow:

Embodiment 1

An earth-boring tool, comprising: a body; and a passively adjustable, aggressiveness-modifying member secured to the body, the passively adjustable, aggressiveness-modifying member being movable between a first position in which the earth-boring tool exhibits a first aggressiveness and a second position in which the earth-boring tool exhibits a second, different aggressiveness responsive to forces acting on the passively adjustable, aggressiveness-modifying member.

Embodiment 2

The earth-boring tool of Embodiment 1, wherein the passively adjustable, aggressiveness-modifying member comprises one of a depth-of-cut limiting device, a cutting element, a pad, an ovoid, and a leg having a rolling cone secured to an end of the leg and wherein the passively adjustable, aggressiveness modifying member is movable from the first position at a first longitudinal and radial position relative to an outer surface of the body to the second position at a second, different longitudinal position, radial position, or both longitudinal and radial position relative to the outer surface of the body.

Embodiment 3

The earth-boring tool of Embodiment 1 or Embodiment 2, wherein the first position corresponds to an extended state, the second position corresponds to a retracted state, the passively adjustable, aggressiveness-modifying member is movable toward the first position at a first rate, and the passively adjustable, aggressiveness-modifying member is movable toward the second position at a second, slower rate.

Embodiment 4

The earth-boring tool of Embodiment 3, wherein the passively adjustable, aggressiveness-modifying member is biased toward the first position.

Embodiment 5

The earth-boring tool of Embodiment 3 or Embodiment 4, wherein the passively adjustable, aggressiveness-modifying member comprises: a formation-engaging structure; a piston operatively connected to the formation-engaging structure, the piston positioned to apply a force on the pad; a biasing member applying a force on the piston toward the first position; a fluid chamber divided by the piston into a first fluid chamber and a second fluid chamber; and a first fluid flow path from the first fluid chamber to the second fluid chamber that controls movement of the piston toward the first position at the first rate and a second fluid flow path from the second chamber to the first chamber that controls movement of the piston toward the second position at the second rate.

Embodiment 6

The earth-boring tool of Embodiment 5, wherein a first check valve, first flow restrictor, or first check valve and first flow restrictor in the first fluid flow path defines the first rate and a second check valve, second flow restrictor, or second check valve and second flow restrictor in the second fluid flow path defines the second rate.

Embodiment 7

The earth-boring tool of Embodiment 5 or Embodiment 6, wherein the piston comprises a double-acting piston and a fluid acting on a first side of the double-acting piston controls at least in part the first rate and a fluid acting on a second, opposite side of the double-acting piston controls at least in part the second rate.

Embodiment 8

The earth-boring tool of any one of Embodiments 5 through 7, wherein the piston is operatively coupled to the formation-engaging structure by one of: a direct mechanical connection and via a fluid.

Embodiment 9

The earth-boring tool of any one of Embodiments 1 through 8, wherein the earth-boring tool is a rolling cone drill bit or a hybrid bit and the passively adjustable, aggressiveness-modifying member is located on a leg extending from the body of the rolling cone drill bit or hybrid bit toward a rolling cone secured to an end of the leg, the passively adjustable, aggressiveness-modifying member enabling the leg to dampen vibration as the rolling cone engages with an underlying earth formation.

Embodiment 10

The earth-boring tool of Embodiment 9, further comprising an additional passively adjustable, aggressiveness-modifying member on each other leg extending from the body of the rolling cone drill bit or hybrid bit.

Embodiment 11

The earth-boring tool of any one of Embodiments 1 through 8, wherein the earth-boring tool is a reamer and the passively adjustable, aggressiveness-modifying member is located on a blade of the reamer, the passively adjustable, aggressiveness-modifying member being configured to modify a depth of cut of cutting elements secured to the blade of the reamer in response to forces applied to the passively adjustable, aggressiveness-modifying member as the cutting elements engage with an earth formation.

Embodiment 12

The earth-boring tool of Embodiment 11, further comprising an additional passively adjustable, aggressiveness-modifying member on each other blade of the reamer.

Embodiment 13

A method of passively adjusting an aggressiveness of an earth-boring tool, comprising: causing a force to be exerted on a passively adjustable, aggressiveness-modifying member secured to a body; and moving the passively adjustable, aggressiveness-modifying member from a first position in which the earth-boring tool exhibits a first aggressiveness to a second position in which the earth-boring tool exhibits a second, different aggressiveness responsive to causing the force to act on the passively adjustable, aggressiveness-modifying member.

Embodiment 14

The method of Embodiment 13, wherein moving the passively adjustable, aggressiveness-modifying member from the first position to the second position comprises increasing the aggressiveness of the earth-boring tool by retracting the passively adjustable, aggressiveness-modifying member from an extended position, toward the body, to a retracted position.

Embodiment 15

The method of Embodiment 14, further comprising subsequently decreasing the aggressiveness of the earth-boring tool by extending the passively adjustable, aggressiveness-modifying member from the retracted position, away from the body, to the extended position.

Embodiment 16

The method of Embodiment 15, wherein retracting the passively adjustable, aggressiveness-modifying member from the extended position to the retracted position comprises retracting the passively adjustable, aggressiveness-modifying member from the extended position to the retracted position at a first rate and wherein extending the passively adjustable, aggressiveness-modifying member from the retracted position to the extended position comprises extending the passively adjustable, aggressiveness-modifying member from the retracted position to the extended position at a second, faster rate.

Embodiment 17

The method of Embodiment 15 or Embodiment 16, wherein extending the passively adjustable, aggressiveness-modifying member from the retracted position to the extended position comprises enabling a biasing member biasing the passively adjustable, aggressiveness-modifying member toward the extended position to extend the passively adjustable, aggressiveness-modifying member from the retracted position to the extended position.

Embodiment 18

The method of any one of Embodiments 13 through 17, wherein the passively adjustable, aggressiveness-modifying member comprises one of a depth-of-cut limiting device, a cutting element, a pad, an ovoid, and a leg having a rolling cone secured to an end of the leg and wherein moving the passively adjustable, aggressiveness-modifying member from the first position to the second position comprises moving the passively adjustable, aggressiveness modifying member from a first longitudinal and radial position relative to an outer surface of the body to a second, different longitudinal position, radial position, or both longitudinal and radial position relative to the outer surface of the body.

Embodiment 19

The method of any one of Embodiments 13 through 18, wherein the earth-boring tool is a rolling cone drill bit or a hybrid bit and the passively adjustable, aggressiveness-modifying member is located on a leg extending from the body of the rolling cone drill bit or hybrid bit toward a rolling cone secured to an end of the leg, and wherein moving the passively adjustable, aggressiveness-modifying member from the first position to the second position comprises dampening vibration experienced by the leg as the rolling cone engages with an underlying earth formation.

Embodiment 20

The method of any one of Embodiments 13 through 18, wherein the earth-boring tool is a reamer and the passively adjustable, aggressiveness-modifying member is located on a blade of the reamer, and wherein moving the passively adjustable, aggressiveness-modifying member from the first position to the second position comprises modifying a depth of cut of cutting elements secured to the blade of the reamer in response to forces applied to the passively adjustable, aggressiveness-modifying member as the cutting elements engage with an earth formation.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. An earth-boring reamer, comprising:

a blade; and a passively adjustable, aggressiveness-modifying member located on the blade, the passively adjustable, aggressiveness-modifying member being movable between a first position in which the reamer exhibits a first aggressiveness and a second position in which the reamer exhibits a second, different aggressiveness responsive to forces acting on the passively adjustable, aggressiveness-modifying member, the passively adjustable, aggressiveness-modifying member configured to modify a depth of cut of cutting elements secured to the blade of the reamer in response to forces applied to the passively adjustable aggressiveness-modifying member as the cutting elements engage with an earth formation.

2. The reamer of claim 1, wherein the passively adjustable, aggressiveness-modifying member comprises one of a depth-of-cut limiting device, a cutting element, a pad, or an ovoid, and wherein the passively adjustable, aggressiveness modifying member is movable from the first position at a first longitudinal and radial position relative to an outer surface of the blade to the second position at a second, different longitudinal position, radial position, or both longitudinal and radial position relative to the outer surface of the blade.

3. The reamer of claim 1, wherein the first position corresponds to an extended state, the second position corresponds to a retracted state, the passively adjustable, aggressiveness-modifying member is movable toward the first position at a first rate, and the passively adjustable, aggressiveness-modifying member is movable toward the second position at a second, slower rate.

4. The reamer of claim 3, wherein the passively adjustable, aggressiveness-modifying member is biased toward the first position.

5. The reamer of claim 3, wherein the passively adjustable, aggressiveness-modifying member comprises:

a formation-engaging structure;

a piston operatively connected to the formation-engaging structure, the piston positioned to apply a force on the pad;

a biasing member applying a force on the piston toward the first position;

a fluid chamber divided by the piston into a first fluid chamber and a second fluid chamber; and a first fluid flow path from the first fluid chamber to the second fluid chamber that controls movement of the piston toward the first position at the first rate and a second fluid flow path from the second chamber to the first chamber that controls movement of the piston toward the second position at the second rate.

6. The reamer of claim 5, wherein a first check valve, first flow restrictor, or first check valve and first flow restrictor in the first fluid flow path defines the first rate and a second check valve, second flow restrictor, or second check valve and second flow restrictor in the second fluid flow path defines the second rate.

7. The reamer of claim 5, wherein the piston comprises a double-acting piston and a fluid acting on a first side of the double-acting piston controls at least in part the first rate and a fluid acting on a second, opposite side of the double-acting piston controls at least in part the second rate.

8. The reamer of claim 5, wherein the piston is operatively coupled to the formation-engaging structure by one of: a direct mechanical connection and via a fluid.

9. The reamer of claim 1, further comprising a rolling cone drill bit or a hybrid bit operatively connected to the reamer, the rolling cone drill bit or the hybrid bit comprising another passively adjustable, aggressiveness-modifying member located on a leg extending from a body of the rolling cone drill bit or the hybrid bit toward a rolling cone secured to an end of the leg, the other passively adjustable, aggressiveness-modifying member enabling the leg to dampen vibration as the rolling cone engages with an underlying earth formation.

10. The reamer of claim 9, wherein the rolling cone drill bit further comprises one or more other legs and further comprising an additional passively adjustable, aggressiveness-modifying member on each other leg extending from the body of the rolling cone drill bit or hybrid bit.

11. The reamer of claim 1, wherein the reamer further comprises one or more other blades and further comprising an additional passively adjustable, aggressiveness-modifying member on each other blade of the reamer.

12. A method of passively adjusting an aggressiveness of a reamer, comprising:

causing a force to be exerted on a passively adjustable, aggressiveness-modifying member secured to a blade; and moving the passively adjustable, aggressiveness-modifying member from a first position in which the reamer exhibits a first aggressiveness to a second position in which the reamer exhibits a second, different aggressiveness responsive to causing the force to act on the passively adjustable, aggressiveness-modifying member by modifying a depth of cut of cutting elements secured to the blade of the reamer in response to forces applied to the passively adjustable, aggressiveness-modifying member as the cutting elements engage with an earth formation.

13. The method of claim 12, wherein moving the passively adjustable, aggressiveness-modifying member from the first position to the second position comprises increasing the aggressiveness of the reamer by retracting the passively adjustable, aggressiveness-modifying member from an extended position, toward the body, to a retracted position.

14. The method of claim 13, further comprising subsequently decreasing the aggressiveness of the reamer by extending the passively adjustable, aggressiveness-modifying member from the retracted position, away from the blade, to the extended position.

15. The method of claim 14, wherein retracting the passively adjustable, aggressiveness-modifying member from the extended position to the retracted position comprises retracting the passively adjustable, aggressiveness-modifying member from the extended position to the retracted position at a first rate and wherein extending the passively adjustable, aggressiveness-modifying member from the retracted position to the extended position comprises extending the passively adjustable, aggressiveness-modifying member from the retracted position to the extended position at a second, faster rate.

16. The method of claim 14, wherein extending the passively adjustable, aggressiveness-modifying member from the retracted position to the extended position comprises using biasing member biasing the passively adjustable, aggressiveness-modifying member toward the extended position to extend the passively adjustable, aggressiveness-modifying member from the retracted position to the extended position.

17. The method of claim 12, wherein the passively adjustable, aggressiveness-modifying member comprises one of a depth-of-cut limiting device, a cutting element, a pad, or an ovoid and wherein moving the passively adjustable, aggressiveness-modifying member from the first position to the second position comprises moving the passively adjustable, aggressiveness modifying member from a first longitudinal and radial position relative to an outer surface of the blade to a second, different longitudinal position, radial position, or both longitudinal and radial position relative to the outer surface of the blade.

* * * * *